United States Patent [19]

Bishilany, III et al.

[11] 4,255,123

[45] Mar. 10, 1981

[54] NON-WARPING RADIANT BURNER CONSTRUCTION

[75] Inventors: William J. Bishilany, III, Seven Hills; Arnold L. Buehl, Solon; Werner H. Zwipf, Parma, all of Ohio

[73] Assignee: Slyman Manufacturing Corporation, Cleveland, Ohio

[21] Appl. No.: 38,216

[22] Filed: May 11, 1979

[51] Int. Cl.[3] ..... F23D 13/12; F23D 13/14

[52] U.S. Cl. ..... 431/328

[58] Field of Search ..... 431/328, 329

[56] References Cited

U.S. PATENT DOCUMENTS

| | | | |
|---|---|---|---|
| 3,008,513 | 11/1961 | Holden | 431/328 |
| 3,407,024 | 10/1968 | Herschberg | 431/328 |
| 4,035,132 | 7/1977 | Smith | 431/328 |
| 4,189,297 | 2/1980 | Bratko | 431/328 |

*Primary Examiner*—George E. Lowrance

*Attorney, Agent, or Firm*—Pearne, Gordon, Sessions, McCoy & Granger

[57] ABSTRACT

A radiant burner having a porous, refractory board matrix through which a combustion mixture is blown and at the outside surface of which it burns, characterized by retaining means to hold the matrix on a shelf without a heat absorbing retaining rim for the matrix and air cooling of the burner frame through such retaining means.

9 Claims, 4 Drawing Figures

NON-WARPING RADIANT BURNER CONSTRUCTION

BACKGROUND OF THE INVENTION

The present invention relates to infrared radiant gas burners or heaters of the type shown and described in U.S. Pat. Nos. 3,785,763; 3,824,064; and 4,035,132.

In this type of burner, the gas-air combustion mixture is blown through a porous refractory board or matrix and caused to burn every efficiency at the outside or burning face of that matrix. The matrix is held on the frame of a burner box by a metal retaining rim extending around the periphery of the outside or burning face of the matrix. The temperature reached at the burning face of such burners are in the order of 1600° F. (870° C.) or more, which means that the metal frame of the burner box and the matrix retaining rim reach comparable temperatures and are subject to severe distortion from such heat. Any distortion or warping of the frame of the burner box in turn affects the plane burning face of the matrix and the seals around the edges of the matrix, with the result that combustion takes place at seal leaks and burns out the burner, or combustion is not even across the face of the burner and the infrared radiation or heating effect is uneven. Whenever any of these events occur, the burner must be replaced.

One of the principal uses of these types of burners at this time is in textile mills where they are used to dry moving webs of fabric as the webs emerge from tanks of liquid dyes, sizings, or the like. The burner matrix is faced vertically, parallel to, and about eight inches away from, the moving fabric web. One of the known advantages of this type of burner is that it heats evenly and, when combustion ceases, cools off rapidly. In textile mill applications of the type described, it can readily be seen that any warping of the burner box frame causing unevenness in the matrix face plane with a resultant unevenness in heating effect cannot be tolerated.

SUMMARY OF THE INVENTION

In the present invention, the edges of the matrix are beveled and the matrix is retained on the burner box frame edge shelf by a wedge of refractory material in combination with spaced holding clips and high temperature sealant-adhesive. The beveled edges of the matrix are coated and sealed with refractory material so that cooling air, which is blown through such refractory material wedge, does not interfere with combustion.

The objects of the present invention are to provide a radiant gas burner in which there is minimal distortion of the burner box frame from the heat of combustion, in which there is suitable edge air cooling of the burner box frame without interference with combustion at the burner face, and in which there is steady and even combustion across the plane burning face of the matrix.

BRIEF DESCRIPTION OF THE DRAWING

These and other objects of the invention will be understood from the description in the specification and disclosure of the drawings, in which.

DESCRIPTION OF THE PREFERRED EMBODIMENT

Figure 1:
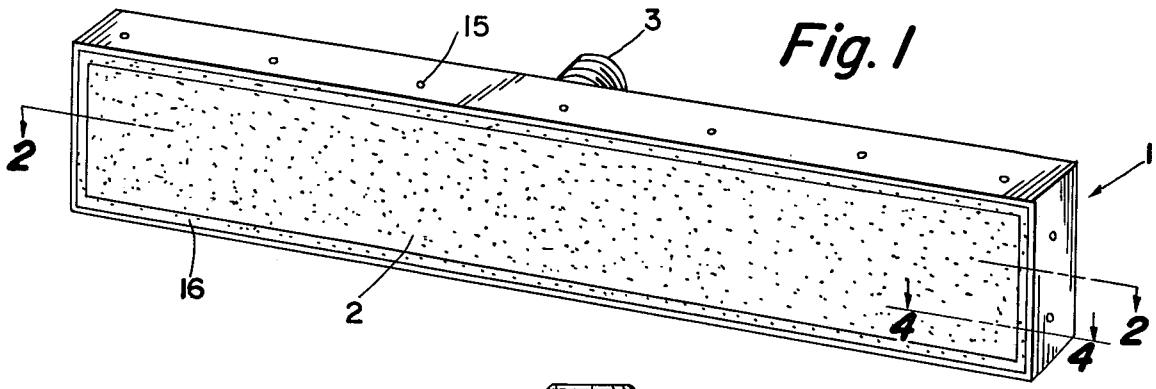
FIG. 1 is a perspective view of a burner box, with the matrix mounted therein in accordance with the present invention. In this instance, the matrix is in a vertical plane.
Figure 2:
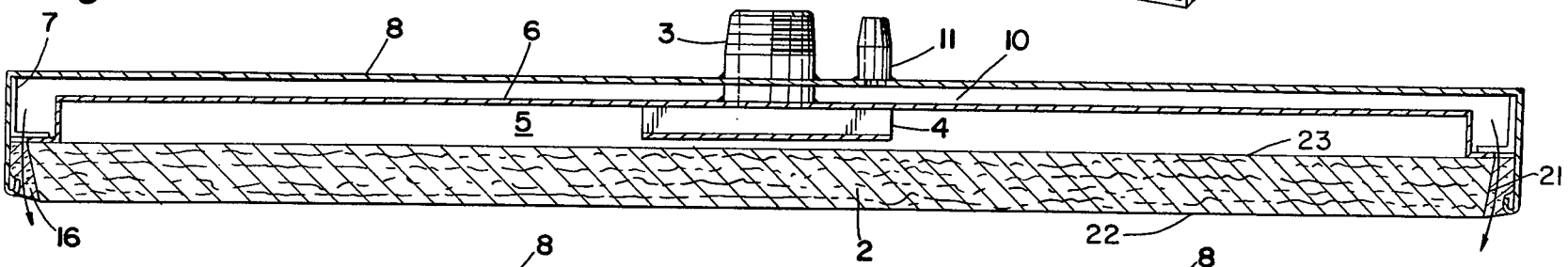
FIG. 2 is a sectional view of the burner of FIG. 1, taken through line 2—2.

The general construction of burners of the present invention is illustrated in FIGS. 1 and 2, and comprises a rectangular burner box 1 which supports a porous, gas-permeable, refractory board panel or matrix 2 having an inner face, outer face, and peripheral edge separating the faces. A combustible gas-air mixture enters into the back of the burner box through an inlet pipe nipple 3 and blows against a baffle 4 inside the burner box so as to be distributed evenly under pressure throughout a combustion mixture plenum chamber 5.

The combustion mixture plenum chamber 5 is defined by the matrix inner face 23 and an inner box 6 which is welded to a number of spaced support brackets 7, which, in turn, are welded to the sides and ends of an outer cooling air box 8. The inner box and outer box together make up the burner box with an open end to receive the matrix 2. The inner box is nested within the outer box and is generally equidistantly spaced from the sidewalls of the outer box, with the open ends of the boxes opening outwardly in the same direction, the open end of the inner box defining the combustion mixture plenum chamber being closed by the matrix. The inner box and the source of the gas-air combustion mixture together comprise the combustion gas mixture plenum means.

A shelf or flat ledge portion 9 about the open-end periphery of the inner box 6 supports and abuts the edge area of the matrix 2. This shelf or ledge 9 is preferably disposed inwardly from the outer burning surface of the matrix a distance which approximates the thickness of the matrix.

A cooling air plenum chamber 10 is defined by the space between the inner box 6 and outer box 8, and is supplied with cooling air by an inlet pipe nipple 11 at the back of the burner box.

The gas-air combustion mixture is under a pressure in the plenum chamber 5 of from about $3\frac{1}{2}$ to 8 inches (8.9–20.3 cm.) water column pressure from a blower or other supply means, as is well known in the art. The cooling air is under a pressure in its plenum chamber 16 of about 3 to 8 inches (7.6–20.3 cm.) of water column pressure, likewise from a blower or other supply means, as is well known in the art. The pressures of both the supply of the combustion mixture and the cooling air should be constant and accurately controlled and adjusted.

The matrix 2 is a porous refractory ceramic fiberboard, preferably made of type 130 Cera Form board, manufactured by Johns-Manville Company. The matrix is a single unitary board of substantially equal porosity throughout so that it burns and heats equally. The boards are manufactured from Cera Form refractory fibers and a multicomponent binder system which burns out at approximately 500° F. (260° C.) The composition of the Cera Form type 130 board is approximately 36% alumina, 54% silica, and 3.5% chromic oxide. The specified density is 13.5 pounds per cubic foot and the specified thermal conductivity is from 0.28 Btu/in., hr., sq. ft. at 400° F. (204° C.) to 1.98 at 2000° F. (1093° C.). The boards lose around one-third of their strength when the binder is burned out. One face is sanded and that, preferably, is the outward or burning face 22 at which combustion takes place. The boards are preferably from about 1 inch to about 1½ or 2 inches (2.54–5.0 cm.) thick.

The matrix 2 should have good insulative properties so that heat from the burning surface is not conducted back into the combustion mixture chamber 5. Actual combustion takes place at or within about ⅛ inch (0.32 cm.) inwardly of the outside burning surface. The porosity of the matrix is generally equal throughout to fully homogenize the combustion mixture. The pressure of the combustion mixture has to be adjusted to the porosity of the matrix. Preferably, the air for both the combustion mixture and cooling is filtered before introduction into the burner.

An important feature of the present invention is that there is no metal retaining rim or frame member as in the burners of U.S. Pat. Nos. 3,824,064 (the remaining rim 18) or 4,035,132 (upper frame members 21, 22, 23, and 24). This, in turn, means that there is no heat absorbing metal part adjacent to the edge of the burning surface of the matrix to conduct heat into the burner box and cause it to warp and otherwise distort as it is heated and cooled in the normal operative cycle.

When a burner operates in a vertical position, as shown in FIG. 1, the distortion at the top edge of the burner box tends to be greatest because the flame rises against it and heats that area much more than the bottom area.

Figure 4:
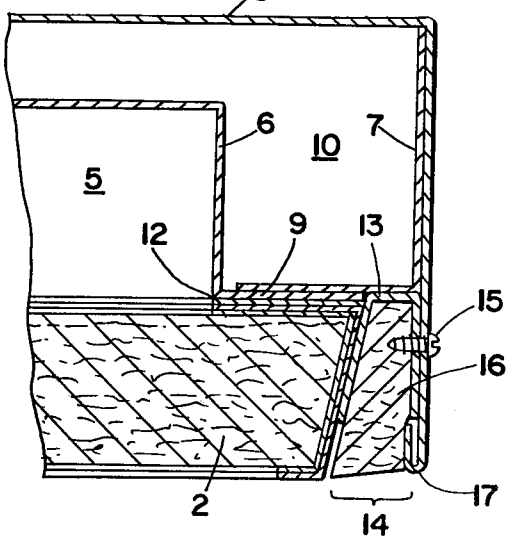
FIG. 4 is an enlarged section of the edge of the matrix and burner box frame, taken through line 4—4 at the matrix retaining clip.
Figure 3:
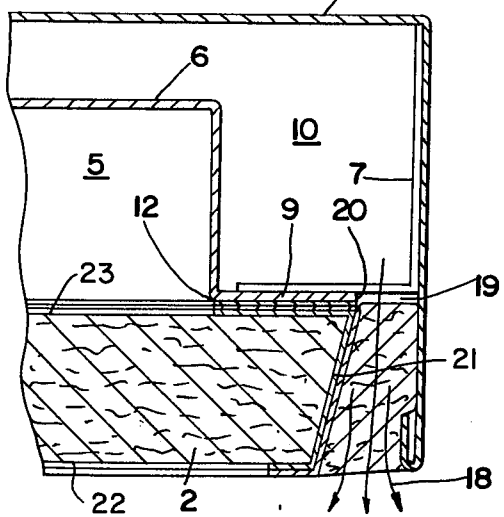
FIG. 3 is an enlarged section of the edge of the matrix and burner box frame, taken through line 2—2.

In accordance with the present invention, the edges 21 of the matrix 2 are beveled outwardly from the burning surface 22 at an angle of from about 10° up to 25° as shown in FIGS. 3 and 4. In other words, when disposed on the shelf 9 around the edges of the inner box, the beveled edge makes an angle of from 65° to 80° with the plane of the shelf edge portion 9 or the plane of the outside burning surface 22 of the matrix, whereby the planar area of the outside burning surface is less than the planar area of the opposed non-burning surface 23 of the matrix 2. The beveling operation may be done with a saw or very shape knife.

The beveled edge 21 is then treated with suitable sealers and rigidizing materials which are refractory in nature or at least have high heat resistance so that a permanent gas-impermeable seal or barrier against passage of the combustion mixture is made. The matrix is next sealed and adhered to the shelf or flange support 9 formed by the peripheral portions of the inner box with suitable rubbery sealing and adhesive material. A number of spaced, narrow metal clip means 13 (FIG. 4) are then inserted in the generally continuous channel 14 formed between the matrix edge and the outer box sides and ends, as shown in FIG. 4, and held in place with sheet metal screws 15 or other suitable fastening means. The clip angle corresponds to the bevel angle and otherwise fits the channel 14 formed between the edge of the matrix 2 and the sidewalls of the outer box 8.

Finally, a retaining means in the preferred form of packing 16 of resilient, porous, refractory material is placed inside the channel 14 and tamped or pressed therein to also help retain the matrix 2 in place on the shelf-edge portion 9. The packing 16 engages and interfaces with the peripheral edge 21 of the matrix which is spaced from the sidewalls of the outer box 8, and overlaps at least a portion of the peripheral edge wherein such portion is sandwiched between the inner box shelf or flange support 9 and the packing 16. The packing extends between the matrix peripheral edge and the sidewalls of the outer box. If desired, the pieces of Cera Form removed from the matrix in the beveling operation may be used as the packing material 16.

Alternatively, a refractory fiber strip of higher densities, preferably at least about 8 lbs. (3.63 kg.) per cu. ft., may be used, such as Kaowool, manufactured by the Babcock & Wilcox Company, or Fiberfrax, manufactured by the Carborundum Company. Both Kaowool and Fiberfrax are alumina-silica fibrous refractory materials. These materials should be tamped or packed into the channel 14 and preferably coated with a colloidal silica rigidizer such as Ludox HS-40, manufactured by E. I. DuPont de Nemours & Company. Since the burner box 1 is alternatively heated and cooled as the burner is ignited and turned off, there is cyclical expansion and contraction in operation of the burner and the packing 16 for the matrix 2 should have sufficient resiliency to adjust to these conditions. A turned edge 17 of the outer box helps to keep the refractory packing in position. The minimum straight-line distance along the sidewall of the outer box between the turned edge 17 and the shelf 9 is less than the thickness of the matrix, preferably by about ⅛ inch (0.32 cm.), wherein the burning surface of the matrix is spaced outwardly away from and set off from the edge 17 to lessen its radiant heating by the burning surface of the matrix 2.

The matrix is thus held and positioned on the shelf 9 by retaining means which comprise a combination of clip 13, sheet metal screw 15, shelf seal and adhesive 12, packing 16, and turned edge 17. There is thus no heat absorbing metal or other heat absorbing material adjacent the edge of the outer or burning surface of the matrix.

The cooling air 18 from the chamber 10 flows through a slot opening or passageway 19 formed between the outer edge 20 (FIG. 3) of the inner box 10 and the sidewalls of the outer box 8 and into the channel 14 through the porous packing 16 and is exhausted out, as shown by the arrows in FIG. 3. Air flow through the passageway is necessarily restricted by the packing wherein the restricted and diffused air flowing through the packing advantageously absorbs heat to provide cooling at the matrix edge by carrying heat away from the adjacent packing. The only interruptions to this air flow are the spacers or brackets 7 and holding clips 13, which interfere with the passage of cooling air to the extent of their widths. In a typical burner construction, the spacers 11 might be 1 to 1½ or 2 inches (2.54–5 cm.) wide and the clips less than the widths of the spacers 11, and these obstructions are therefore of no significance.

The beveled edge 21 of the matrix 2 is treated for the purpose of creating a gas-impermeable barrier or seal interface between the packing and the matrix edge which separates the cooling air from the burning surface and prevents the combustible mixture from penetrating through or around it and burning somewhere other than the outside or burning surface of the matrix 2, for instance, at the shelf 9 or in the channel 14. The treatment comprises first impregnating the beveled edge 21 with a refractory sealing and penetrating silica compound, such as Ludox HS-40, manufactured by E. I. DuPont de Nemours & Co. Ludox HS-40 is an aqueous colloidal silica depression of discrete particles of surface-hydroxylated silica, alkali stabilized.

The silica penetrates the edge portions of the matrix. Two or more coats may be applied with suitable drying in between.

Over the silica, it is advisable to apply a mixture of about equal parts of alumina-silicate refractory cement, such as Whiteline cement, manufactured by Fireline, Inc. of Youngstown, Ohio, and colloidal silica. Whiteline cement is an alumina-silicate mixed with about 50% colloidal silica. The Whiteline cement/Ludox mixture stiffens the matrix edge and may also be used to help bond it to the packing wedge 16. The Whiteline cement-/Ludox mixture is also preferably applied to the surfaces of the packing wedge 16 prior to inserting it in the channel 14.

As will be apparent to those skilled in the art, other refractory sealers and bonding materials may be used for these purposes, such as magnesite (MgO), forsterite ($MgO\text{-}SiO_2$), burned dolomite (CaO-MgO), and alumina ($Al_2O_3$). We prefer materials which do not crack or spall and are resistant to thermal shock. Kaowool surface coating cement, manufactured by the Babcock & Wilcox Company, may be used on the beveled edge over a Ludox HS-40 coating layer.

The Ludox HS-40 colloidal silica sealer should also preferably be applied to the inner surface of the matrix where it is to be cemented to the shelf 9. The cement for that purpose may be a rubbery, high-temperature-resistant silicone cement such as Dow Corning clear silicone, Catalogue Number 732-CL 111. The contact between the shelf and inside edge of the matrix, that is, the inside surface of the matrix which is opposite to the outer burning surface, in normal operation, is not heated to such an extent that a refractory-type cement is needed. If in use it is discovered that the temperatures are too high for the silicone cement, then a refractory cement may be used. The rubbery silicone cement has a greater holding power than a refractory cement and that is why we prefer it in this circumstance.

One advantage of the structure of the present invention is that the matrix may be replaced should it lose its shape or be damaged. We contemplate that the matrix need not be a flat board but could be a hat or other non-planar shaped matrix.

This invention is not restricted to the slavish limitation of each and every one of the details described above by way of example. Obviously, devices may be made which change, eliminate, or add specific details but which do not depart from our invention.

What is claimed is:

1. A radiant burner comprising an inner box which has a shelf around its edges, an outer box, a refractory fiberboard matrix with edges being beveled outwardly, porous resilient refractory means wedged between the edges of the matrix and the sides of the outer box to overlap said beveled edges and retain the edge portions of the matrix on the inner box shelf, the inside of the inner box and the matrix defining the plenum chamber for the combustion mixture, the outside of the inner box and the inside of the outer box defining the plenum chamber for the cooling air, means to supply a combustion mixture and cooling air respectively to the combustion plenum chamber and cooling air plenum chamber, slot openings between the edges of the inner box and the sides of the outer box outside of the shelf for the passage of cooling air through said porous refractory means, and a refractory sealant on the edges of the matrix to rigidify them and seal them against the combustion mixture, the said sealed edges being inwardly disposed from said porous refractory means, whereby the matrix is retained on the inner box shelf and the combustion mixture burns in the outside surface of the matrix inwardly from the sealed edges.

2. A radiant burner comprising an inner box, an outer box, and a porous refractory board matrix mounted on a shelf which is integral with the inner box around the edges of the matrix, porous resilient refractory material pressed between the edges of the matrix and the sides of the outer box to help hold the matrix on said shelf, and a plurality of narrow spaced apart metal clips disposed between the edges of the matrix and the sides of the outer box to help hold the matrix on said shelf, the inside of the inner box and the matrix defining the plenum chamber for the combustion mixture, the outside of the inner box and the inside of the outer box defining the plenum chamber for the cooling air, the inner box being supported on brackets integral with the outer box to provide openings for the passage of cooling air from the cooling air plenum chamber through the porous refractory material, the edges of the matrix being sealed to the supporting shelf, being refractorily sealed against the combustion mixture, and being rigidified by said refractory sealant.

3. A burner comprising a burner box with an open face and a flat porous refractory fiber matrix disposed on said face which covers a combustion mixture plenum chamber, means for introducing a combustion mixture into said plenum chamber so that the mixture flows through the matrix and burns at its outer surface, an inner box, the inside of which defines, with the matrix, the combustion mixture plenum chamber, means for introducing cooling air into a cooling air plenum chamber, an outer box, the inside of the outer box and the outside of the inner box defining the cooling air plenum chamber and the inner box and outer box together forming the burner box, means to mount the inner box inside of the outer box, a shelf which is an integral portion of the inner box and is formed around the edges of the inner box a distance inwardly from the outer surface of the matrix approximately equivalent to the thickness of the matrix, the edges of the matrix being beveled outwardly at an angle of from 65 to 80 degrees from the plane of the outside burning surface of the matrix and being sealed against the combustion mixture with a refractory sealant, metal clip means attached to the edges of the outer box to help hold said matrix on said shelf, porous resilient refractory fiber material mounted between said beveled edges and the sides of the burner box, a sealant and adhesive on said shelf to seal and adhere the matrix edges to it and prevent the passage of any combustion mixture therethrough, and slot openings around the edges of said outer box outside of said shelf to permit the passage of cooling air therethrough from said cooling air plenum chamber into said porous resilient refractory fiber material to cool the edges of the burner box.

4. A radiant burner according to claim 3, in which the top edge of the outer box is turned inwardly to help keep the refractory fiber material in position.

5. A radiant burner according to claim 3, in which the surface of the refractory fiber material is coated with a colloidal silica rigidifier.

6. A radiant burner according to claim 3, in which the inside edges of the matrix are sealed to the shelf with a flexible silicone rubber cement.

7. A gas-fired radiant burner comprising an outer box having sidewalls and at least one open end, an inner box nested within and generally equidistantly spaced from the sidewalls of the outer box, the inner box having at least one open end, the open ends of the inner and outer boxes opening outwardly in the same direction wherein a generally continuous channel is formed between the boxes at their open ends, a gas-permeable refractory fiberboard unitary matrix closing the open end of the inner box, the peripheral edge of the matrix being spaced from the sidewalls of the outer box and being beveled outwardly from the outer burning surface thereof, a porous resilient refractory packing press-fitted into the channel, the packing extending between the peripheral edge of the matrix and the sidewalls of the outer box, the refractory packing engaging and overlapping at least a portion of the peripheral edge of the matrix to hold the matrix in position against the open end of the inner box, the refractory packing extending around the matrix and substantially closing the channel, means for supplying a combustion mixture to pressurize the inner box wherein the mixture is exhausted through the matrix for burning at the outer surface thereof, means for supplying a non-combustible pressurized cooling gas to the outer box wherein the cooling gas is exhausted and diffused through the porous refractory packing to provide cooling to the peripheral edge of the matrix, there being a gas-impermeable refractory seal located at the interface area between the refractory packing and the peripheral edge of the matrix, the seal establishing a barrier to the passage of the combustion mixture from the matrix peripheral edge to the porous refractory packing.

8. A gas-fired radiant burner comprising a gas-permeable matrix of refractory fiber material at least about one inch thick providing a generally equal degree of porosity throughout, the matrix having an inner face, outer face, and gas non-permeable peripheral edge area separating the faces, said matrix being beveled outwardly from said outer face, combustion gas mixture plenum means sealed against the inner face of the matrix to supply a pressurized combustible gas mixture thereto for burning at the outer face of the matrix, a porous gas-permeable refractory packing fixed relative to the plenum means and engaging the peripheral edge area of the matrix, a multiplicity of narrow metal clips spaced about the peripheral edge area of said matrix whereby the packing and clips retain the matrix in sealing engagement with the plenum means against the force of the pressurized combustible gas mixture supplied to the inner face of the matrix, and supply means providing pressurized non-combustible cooling gas to the refractory packing, the cooling gas flowing and diffusing generally throughout the packing to carry heat away from the packing.

9. A burner having a combustion mixture plenum chamber, a porous refractory fiber matrix which is at least one inch thick and which covers the combustion mixture plenum chamber, means for introducing the combustion mixture into the plenum chamber so that the mixture flows through the matrix and burns at its outer surface, a cooling air plenum chamber, means for introducing cooling air into the cooling air plenum chamber, a shelf disposed around the combustion mixture plenum chamber to receive the edges of the matrix, said edges being beveled outwardly at angles of from 10° to 25°, refractory sealing material around the edges of the matrix to prevent the passage of combustion mixture therethrough and to rigidify said edges, porous resilient refractory fiber material around the edges of the matrix to help hold it on said shelf, a multiplicity of narrow clip means spaced around the edges of the matrix to help hold it on said shelf, and openings from said cooling air plenum chamber into said porous resilient refractory fiber material to permit cooling air to flow through said material outside the sealed edges of the matrix.

* * * * *